United States Patent [19]

Hess

[11] Patent Number: 4,572,605

[45] Date of Patent: Feb. 25, 1986

[54] INJECTION MOLDED IN-LINE CONNECTOR ASSEMBLY FOR BIPOLAR LEADS

[75] Inventor: Douglas N. Hess, Maple Grove, Minn.

[73] Assignee: Medtronic, Inc., Minneapolis, Minn.

[21] Appl. No.: 639,073

[22] Filed: Aug. 9, 1984

[51] Int. Cl.[4] ..... H01R 17/18

[52] U.S. Cl. ..... 339/177 R; 339/183; 339/218 M; 339/276 R; 339/275 R

[58] Field of Search ..... 339/218, 177, 213 R, 339/276 R; 128/784, 785, 786

[56] References Cited

U.S. PATENT DOCUMENTS

| | | | |
|---|---|---|---|
| 2,983,895 | 5/1961 | Pasik | 339/177 R |
| 3,416,533 | 12/1968 | Fischer et al. | 128/786 |
| 3,871,735 | 3/1975 | Hermann, Jr. | 339/177 R |
| 4,266,844 | 5/1981 | Chelminski | 339/218 M |
| 4,334,730 | 6/1982 | Colwell et al. | 339/218 R |
| 4,387,727 | 6/1983 | Sandstrom | 339/177 R |

FOREIGN PATENT DOCUMENTS

| | | | |
|---|---|---|---|
| 955437 | 4/1964 | United Kingdom | 339/218 M |

*Primary Examiner*—Gil Weidenfeld
*Assistant Examiner*—David L. Pirlot
*Attorney, Agent, or Firm*—Reed A. Duthler; John L. Rooney; Joseph F. Breimayer

[57] ABSTRACT

An in-line connector assembly for use with electrode leads employing plural, coaxial, coiled conductors. The connector assembly includes a connector ring, a connector pin, and an insulating sleeve separating the connector ring and connector pin. The insulating sleeve is molded to the connector ring and connector pin, prior to attachment to the proximal end of a multiconductor lead.

4 Claims, 3 Drawing Figures

INJECTION MOLDED IN-LINE CONNECTOR ASSEMBLY FOR BIPOLAR LEADS

BACKGROUND OF THE INVENTION

This invention pertains generally to electrode leads, and more particularly to the manufacture of in-line connector assemblies for electrode leads.

In-line connector assemblies for electrode leads employing coaxial conductors have been made and used for some time. Typically, such a connector includes a connector ring coupled to the outer coiled conductor and a connector pin, located proximal to the connector ring and coupled to the inner coiled conductor. Connection of the ring and pin to their respective conductors was typically accomplished by crimping or swaging. One such connector was used on the Model 4002 pacing lead, made and sold in the United States by Medtronic, Inc.

This prior art in-line connector employed a silicone rubber insulating sleeve separating the connector pin and connector ring. This insulating sleeve was molded to the connector assembly following the attachment of the connector ring and connector pin to their appropriate conductor coils. Silicone rubber was particularly advantageous in this construction, because of its low required molding temperature, which allowed molding to take place late in the assembly of the lead, without worry of damage to the already assembled lead components due to high temperatures. Unfortunately, any defect in the molding of the sleeve resulted in the scrapping of the entire lead, as disassembly was not feasible. Other plastics such as polyurethane display greater tensile strength and rigidity, which would be beneficial in this application. However, the high required molding heat for polyurethane effectively precludes its use in an insulating sleeve molded to an already assembled lead.

SUMMARY OF THE INVENTION

The present invention discloses a bipolar, in-line connector assembly in which polyurethane is used to form the insulating sleeve intermediate the connector ring and connector pin. This improvement is accomplished by a novel structure and a method which includes molding of the insulating sleeve apart from those portions of the lead which might be damaged by high temperatures. The urethane insulating sleeve is molded directly to the connector ring and pin, which being made of stainless steel or other inert metal, are not damaged by the heat and pressure required to injection mold polyurethane. After curing, the connector ring, insulating sleeve, and connector pin are attached as a unit to the proximal end of an appropriately prepared bipolar coaxial lead.

The invention provides an in-line connector assembly having increased strength as compared to the prior art connector assembly. Further, because molding is accomplished apart from the lead and prior to attachment of the ring and pin to the lead conductors, defects in the molding process do not result in the scrapping of an entire lead, but only of the improperly molded polyurethane portion.

DETAILED DESCRIPTION OF THE DRAWINGS

Figure 1:
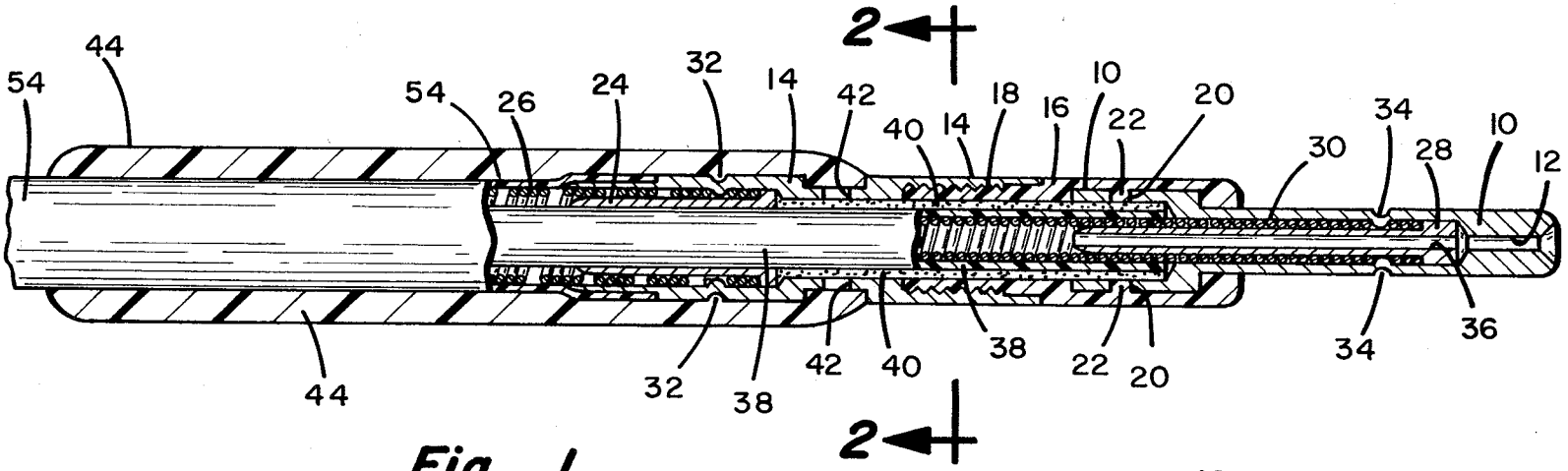
FIG. 1 is a side sectional view of a bipolar, in-line connector assembly according to the present invention.

FIG. 1 shows a side sectional view of a bipolar pacing connector according to the present invention. At the proximal end of the assembly can be seen connector pin 10, which is provided with a central lumen 12, through which a stylet may be inserted. Distal to connector pin 10 is connector ring 14, which is separated from connector pin 10 by insulating sleeve 16. Insulating sleeve 16 is an injection molded part, molded to connector ring 14 and connector pin 10. Molding of insulating sleeve 16 is discussed below in connection with FIG. 3.

Figure 2:
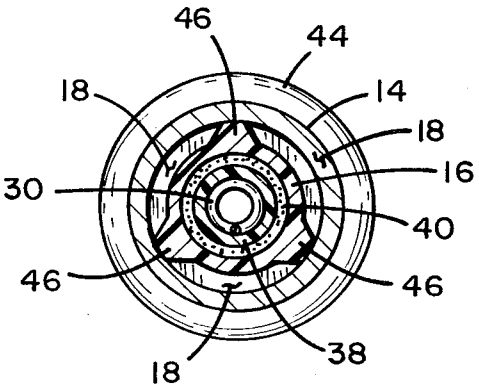
FIG. 2 is a cross sectional view of the connector ring utilized in the bipolar connector assembly of FIG. 1.

Connector ring 14 and sleeve 16 are maintained in fixed relationship to one another by means of screw threads 18 which are machined in the inner lumen of connector ring 14. Screw threads 18 are broached in three places, as illustrated in FIG. 2 below. When sleeve 16 is injection molded, it fills the recesses defined by screw threads 18, preventing axial movement of sleeve 16 relative to the connector ring, as well as filling the three broaches (FIG. 2), preventing rotational movement of sleeve 16, relative to connector ring 14. Connector pin 10 is provided with two bores 20, into which polyurethane flows during the injection molding process of sleeve 16. The polyurethane plugs 22 within bores 20 provide an additional useful function discussed below. Shoulder 21 of sleeve 16 prevents movement of pin 10 in a proximal direction.

Connector ring 14, insulating sheath 16 and connector pin 10 are attached as a unitary structure to the proximal end of a bipolar electrode lead. Prior to attachment, the lead must be appropriately prepared by trimming the proximal end of the lead as illustrated, so that inner conductor coil 30 extends proximal to inner insulative sheath 38, which extends proximal to outer conductor coil 26, which in turn extends proximal to outer insulative sheath 54. Trimming is followed by the insertion of crimping core 24 into the proximal end of outer coil conductor 26 and the insertion of crimping core 28 into the proximal end of inner coil 30. Connector ring 14, insulating sleeve 16 and connector 10 are slid as a unit over the prepared end of the pacing lead, and crimps are made at locations 32 and 34. Crimps at 32 hold outer conductor coil 14 in firm contact with both connector ring 14 and crimping core 24. Crimps at 34 hold inner conductor coil 30 in firm contact with both connector pin 10 and crimping core 28. As an alternative to crimping, swaging or other attachment methods could also be used. Crimping core 28 is seen to be provided with an internal lumen 36 aligned with lumen 12 of connector pin 10, allowing for passage of a stylet therethrough. Inner conductor coil 30 is insulated from outer conductor coil 26 by means of inner insulative sheath 38.

Following the crimping of connector ring 14 and connector pin 10 to their appropriate conductors, the connector assembly is back-filled with medical adhesive 40 by means of bores 42 in connector ring 14. Back-filling the connector assembly with medical adhesive seals the void between inner insulative sheath 38 and the interior surfaces of the lumens of connector ring 14, connector pin 10 and insulating sleeve 16 both in the area of threads 18 and in the area of bores 20, providing a fluid seal and causing frictional resistance to movement of pin 10, ring 14 and sleeve 16. Because the urethane plastic that forms plugs 22 is transparent, the plugs are useful as viewing ports during the backfilling of adhesive 40 allowing visual confirmation that the backfilling has been completed.

Finally, boot 44, which may be fabricated of silicone rubber, is slid over the connector assembly and into circumferential groove 41 and serves to seal bores 42 against fluid ingress.

FIG. 2 shows a cross-sectional view of the connector assembly, as seen from its proximal end.

Connector ring 14 is seen in cross section, surrounded by boot 44. Threads 18 of connector ring 14 are seen to be broached in three locations 46. Within the interior of connector ring 14 is insulating sleeve 16 which is seen to fill the broaches 46 of threads 18. As discussed above, this feature prevents insulating sheath 16 from rotating relative to connector ring 14 and thereby unscrewing from threads 18. Inner conductor 30, surrounded by inner insulative sheath 38 is seen mounted within and frictionally coupled to insulating sleeve 16 by means of medical adhesive 40, which has been injected into the lead, as described above.

Figure 3:
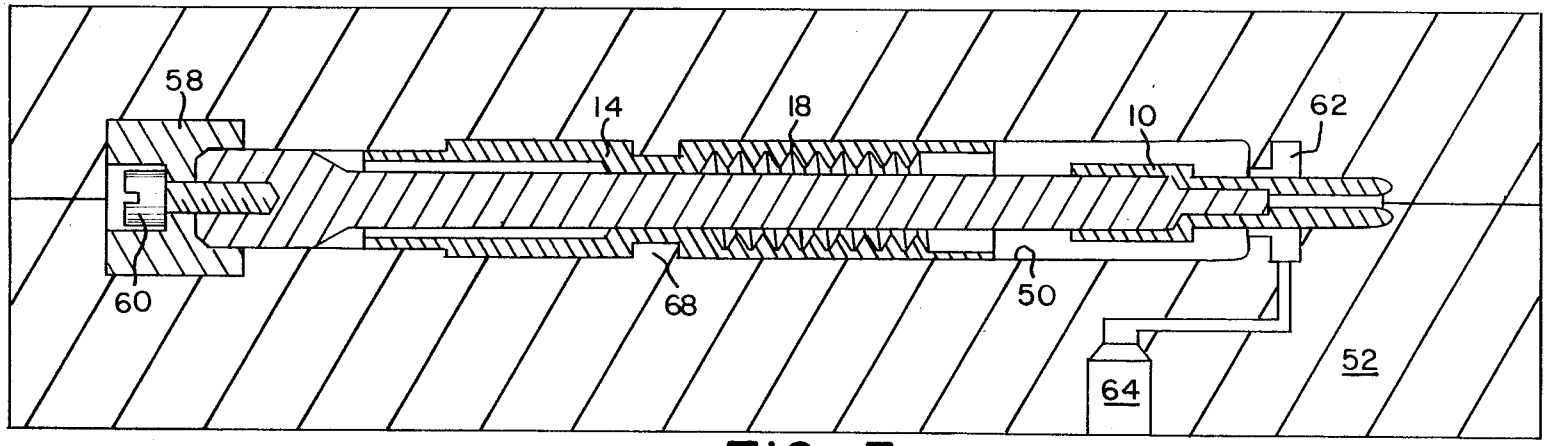
FIG. 3 is a side sectional view showing the manner in which the insulating sleeve is molded to the ring and pin.

FIG. 3 shows a side sectional view of connector pin 10 and connector ring 14 mounted on an appropriate mandrel 48 and inserted within the mold cavity 50 of an injection mold 52. This illustration is not intended to provide a detailed disclosure of the injection mold, but is intended merely to illustrate the basic manner in which mandrel 48, connector ring 14, connector pin 10 and mold 52 interact to define the mold cavity in which insulating sleeve 16 is molded. Mandrel 48 is held in place in the mold by block 54 and screw 60. Ring 10 is held in place by projections 68 and 70. The polyurethane may enter the mold via entry port 64 and may conveniently enter the mold cavity by means of a ring gate 62. Additional details of the injection molding process will be familiar to those skilled in the art.

After molding, the assembly of pin 10, ring 14 and insulating sleeve 16 is removed from the mold, mandrel 48 is removed from the interior of the assembly, and any molding flash is removed. The assembly is then ready for attachment to the previously prepared proximal end of a pacing lead, as discussed above.

The present invention has been described in terms of a bipolar in-line connector assembly. However, the invention is believed applicable as well to connector assemblies for use with leads having three or more conductors, and the following claims should not be construed as limited to a bipolar embodiment only. In connection with the above disclosure, we claim:

1. An in-line connector assembly for use in a pacing lead of the type having an inner conductor coil, an inner insulative sheath surrounding said inner conductor coil, an outer conductor coil surrounding said inner insulative sheath, and an outer insulative sheath surrounding said outer conductor coil, comprising:

a connector ring of conductive metal, having a longitudinal lumen open to the proximal and distal ends of said connector ring, said connector ring coupled to said outer conductor coil;

a connector pin having a longitudinal lumen open to the proximal and distal ends of said connector pin, said connector pin coupled to said inner conductor coil;

an insulating sleeve, molded to the proximal end of the lumen of said connector ring and to the exterior of the distal end of said connector pin; and wherein the lumen of said connector ring is provided with means for preventing longitudinal and rotational movement of said insulating sleeve relative to said connector ring and wherein said insulating sleeve has a lumen connecting the lumen of said connector ring to the lumen of said connector pin and wherein the diameter of the lumens of said connector ring, connector pin and insulating sleeve are greater than the diameter of said inner insulative sheath, and wherein said connector ring is provided with at least one bore open to the lumen of said connector ring whereby said connector assembly may be backfilled with adhesive through said bore of said connector ring, frictionally attaching said connector ring, insulating sleeve and connector pin to said inner insulative sheath.

2. A lead according to claim 1 wherein said connector pin is provided with at least one bore, open to the lumen of said connector pin at a point where the lumen of said connector pin is greater in diameter than said inner insulative sheath and wherein said insulating sleeve is fabricated of a transparent material, whereby the back-filling of said connector assembly with medical adhesive can be checked by means of said bore in said connector pin.

3. A connector assembly according to claim 1 wherein said means for preventing movement of said insulating sleeve relative to said connector ring comprises screw threads in the lumen of said connector ring.

4. A connector assembly according to claim 3 wherein said screw threads in the lumen of said connector ring are broached in at least one location.

* * * * *